US006176325B1

(12) United States Patent
Rodger

(10) Patent No.: US 6,176,325 B1
(45) Date of Patent: Jan. 23, 2001

(54) MOLING APPARATUS AND A GROUND SENSING SYSTEM THEREFOR

(75) Inventor: Albert Alexander Rodger, Aberdeen (GB)

(73) Assignee: Aberdeen University, Aberdeen (GB)

( * ) Notice: Under 35 U.S.C. 154(b), the term of this patent shall be extended for 0 days.

(21) Appl. No.: 09/125,721

(22) PCT Filed: Feb. 11, 1997

(86) PCT No.: PCT/GB97/00389

§ 371 Date: Dec. 22, 1998

§ 102(e) Date: Dec. 22, 1998

(87) PCT Pub. No.: WO97/31175

PCT Pub. Date: Aug. 28, 1997

(30) Foreign Application Priority Data

Feb. 26, 1996 (GB) ..... 9603982

(51) Int. Cl.[7] ..... E21B 7/24

(52) U.S. Cl. ..... 175/50; 175/56; 175/293

(58) Field of Search ..... 175/50, 19, 293, 175/24, 27, 56; 702/6, 11; 173/91, 4, 19, 210, 211, 11, 13

(56) References Cited

U.S. PATENT DOCUMENTS

| | | | | |
|---|---|---|---|---|
| 4,806,153 | | 2/1989 | Sakai et al. | 73/151 |
| 5,031,706 | | 7/1991 | Spektor | 175/19 |
| 5,311,950 | * | 5/1994 | Spektor | 175/19 |
| 5,398,537 | * | 3/1995 | Michalewski et al. | 72/430 |
| 5,549,170 | | 8/1996 | Barrow | 175/55 |
| 5,850,884 | * | 12/1998 | Rodger et al. | 173/91 |

FOREIGN PATENT DOCUMENTS

| | | |
|---|---|---|
| 28 47 128 | 5/1980 | (DE) . |
| 0 056 872 | 8/1982 | (EP) . |
| 0146324 | 6/1985 | (EP) . |
| 2 185 508 | 7/1987 | (GB) . |
| WO 95/29320 | 11/1995 | (WO) . |

* cited by examiner

*Primary Examiner*—David Bagnell
*Assistant Examiner*—Zakiya Walker
(74) *Attorney, Agent, or Firm*—Woodcock Washburn Kurtz Mackiewicz & Norris LLP

(57) ABSTRACT

The invention provides a ground sensing system (10) comprising: sensing means (19) located, in use, on a projectile being driven through ground by means of apparatus having a self adjustment between a vibration mode and a vibro-impact mode according to encountered ground resistance, the sensing means sensing the dynamic resistance of the ground that the projectile is passing through; signal processing means for processing the output of said sensing means to provide a dynamic resistance waveform (106); and waveform recognition means (108) for correlating said dynamic resistance waveform with stored dynamic waveforms for identifying a ground characteristic. The waveform recognition means may comprise a neural network system.

9 Claims, 5 Drawing Sheets

MOLING APPARATUS AND A GROUND SENSING SYSTEM THEREFOR

The present invention relates to a moling apparatus and a ground sensing system therefor. More particularly, the present invention relates to a moling apparatus for forming tunnels to provide trenchless laying techniques.

Moling apparatus can be used for the purpose of, amongst other things, making holes in the ground for explosives say, driving piles or coring tubes into the ground, or making underground tunnels in the ground to receive pipes, cables or the like.

WO-A-95/29320 describes a moling apparatus comprising a housing having a head for penetrating ground disposed at the front end thereof, an anvil disposed in the housing and connected to the head, and a hammer disposed in the housing and spaced from the anvil by resilient restraint means. A vibrator unit, also provided within the housing, is spaced from the hammer and arranged to transfer vibration to the housing and the hammer. In a first mode of operation, vibration of the vibrator unit is transmitted to the housing for causing fluidization of the surrounding ground to allow progressive penetration of the apparatus. In a second mode of operation, the braking effect of the ground on the head causes the hammer to move against the resilient means and impact the anvil thereby driving the head through the ground. Thus, the moling apparatus self adjusts its mode of operation according to the type and condition of the ground being encountered. Indeed, the apparatus self adjusts within each mode, that is to say, it self adjusts the amplitude of the vibration of the vibrator unit or the magnitude of the impact.

The use of a moling apparatus for the above purpose of forming tunnels has particular importance because trenches do not need to be dug and because trenchless laying techniques are less labour intensive and harmful to the local environment. Unfortunately, the ground through which the moling apparatus must form tunnels can typically include many unknown underground obstacles such as cables, pipes, foundations, large rocks etc. Since the moling apparatus is effectively blind to such obstacles, the obstacle can either present an insurmountable barrier to the progress of the apparatus or the moling apparatus can cause undesirable and expensive damage to the obstacle, for example cracking underground pipes.

To avoid this problem, it is possible to consult ground plans or conduct sophisticated underground radar scanning tests as a form of ground sensing in order to map out an unobstructed route for the tunnel. However, this is time consuming, expensive, and ineffective. Furthermore, it does not provide any guarantee of successfully anticipating every underground obstacle. For the aforementioned reasons, moling apparatus have not been as extensively used for the purpose of tunnelling as would otherwise have been the case.

It is an object of the present invention to provide a simple ground sensing system for identifying ground characteristics to enable forewarning against obstacles present in the ground through which a projectile is passing.

It is another object of the present invention to provide a moling apparatus having a simple to use ground sensing system for providing forewarning against obstacles present in the ground through which the apparatus is tunnelling.

It is also an object of the present invention to provide a moling apparatus having means for steering to enable the apparatus to be directed around obstacles present in the ground through which the apparatus is tunnelling.

According to one aspect of the present invention there is provided a ground sensing system comprising:

sensing means located, in use, on a projectile being driven through ground by means of apparatus having a self adjustment between a vibration mode and a vibro-impact mode according to encountered ground resistance, the sensing means sensing the dynamic resistance of the ground that the projectile is passing through;

signal processing means for processing the output of said sensing means to provide a dynamic resistance waveform; and waveform recognition means for correlating said dynamic resistance waveform with stored dynamic waveforms for identifying a ground characteristic.

In this way, it is possible to obtain forewarning of obstacles etc and the like in front of the projectile on which the sensing means is located. It will be appreciated that the term projectile can include a moling apparatus used for making holes in the ground, for driving piles or coring tubes into the ground, or for making underground tunnels in the ground.

In one embodiment, said waveform recognition means comprises a neural network system.

Such a network enables good matching with the stored waveforms and educated guesses in the case of less good matching.

In another embodiment, said waveform recognition means comprises a fuzzy logic system.

It is preferred that the system further comprises display means for providing an output signal indicative of the identified ground characteristic.

Thus, an operator can actively "see" what is happening at and in front of the projectile.

Conveniently, said display means displays the identified ground characteristic to an operator.

Thus, an operator is given quick feedback as regards obstacles and the like which the projectile is encountering.

Preferably, the system further comprises a store means containing a library of dynamic waveforms.

Consequently, the system can be readily used once the library contents are obtained.

In another embodiment, the system further comprises a store means for storing a library of dynamic waveforms in accordance with operator information and dynamic waveforms provided by said signal processing means.

Consequently, the system can be calibrated to real situations on the basis of the projectile on which the sensing means is located.

The present invention also encompasses a moling apparatus having a self adjustment between a vibration mode and a vibro-impact mode and including a ground sensing system as hereinabove defined.

Preferably, the moling apparatus comprises:

a head;

a vibrator unit connected to apply vibrations to the apparatus for providing said vibration mode of vibration driven penetration of ground;

a hammer vibrated by the vibrator unit;

an anvil;

resilient means provided to apply a separating force to keep the anvil and hammer a selected distance apart;

wherein the vibrator unit self adjusts to increase the amplitude displacement of the vibrated hammer according to increased penetration resistance from said ground until a point where said amplitude displacement overcomes said separating force by an amount resulting in the hammer striking the anvil for said vibro-impact mode of vibration and impact driven penetration of ground.

According to another aspect of the present invention there is provided a moling apparatus comprising:

an elongate shell;

a ground penetrating head located at a forward end of said shell; and a fluid jet arrangement for projecting fluid at an area of ground adjacent to the apparatus.

Thus, it is possible to steer the apparatus.

Preferably, the fluid jet arrangement comprises one or more apertures provided adjacent the ground penetrating head and/or a rear end of the shell.

This enables convenient steering.

The fluid jet arrangement may comprise one or more apertures which are movable for projecting fluid in different directions relative to the apparatus.

In another embodiment, the movable apertures are mounted for annular rotation about an axis of the apparatus.

Preferably, the fluid jet arrangement comprises at least one aperture located at said ground penetrating head.

The present invention also encompasses a coring apparatus having a self adjustment between a vibration mode and a vibro-impact mode and including a ground sensing system as hereinabove defined.

An example of the present invention will now be described with reference to the accompanying drawings, in which.

Figure 4:
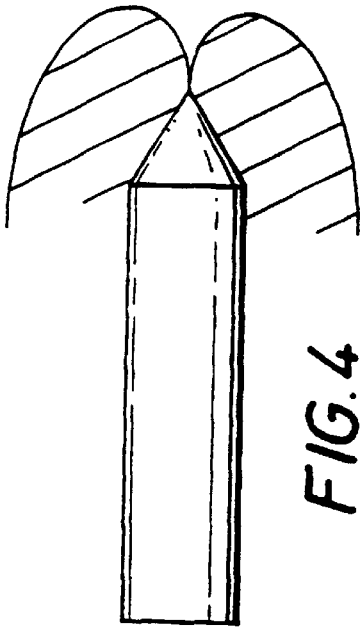
Figure 5:
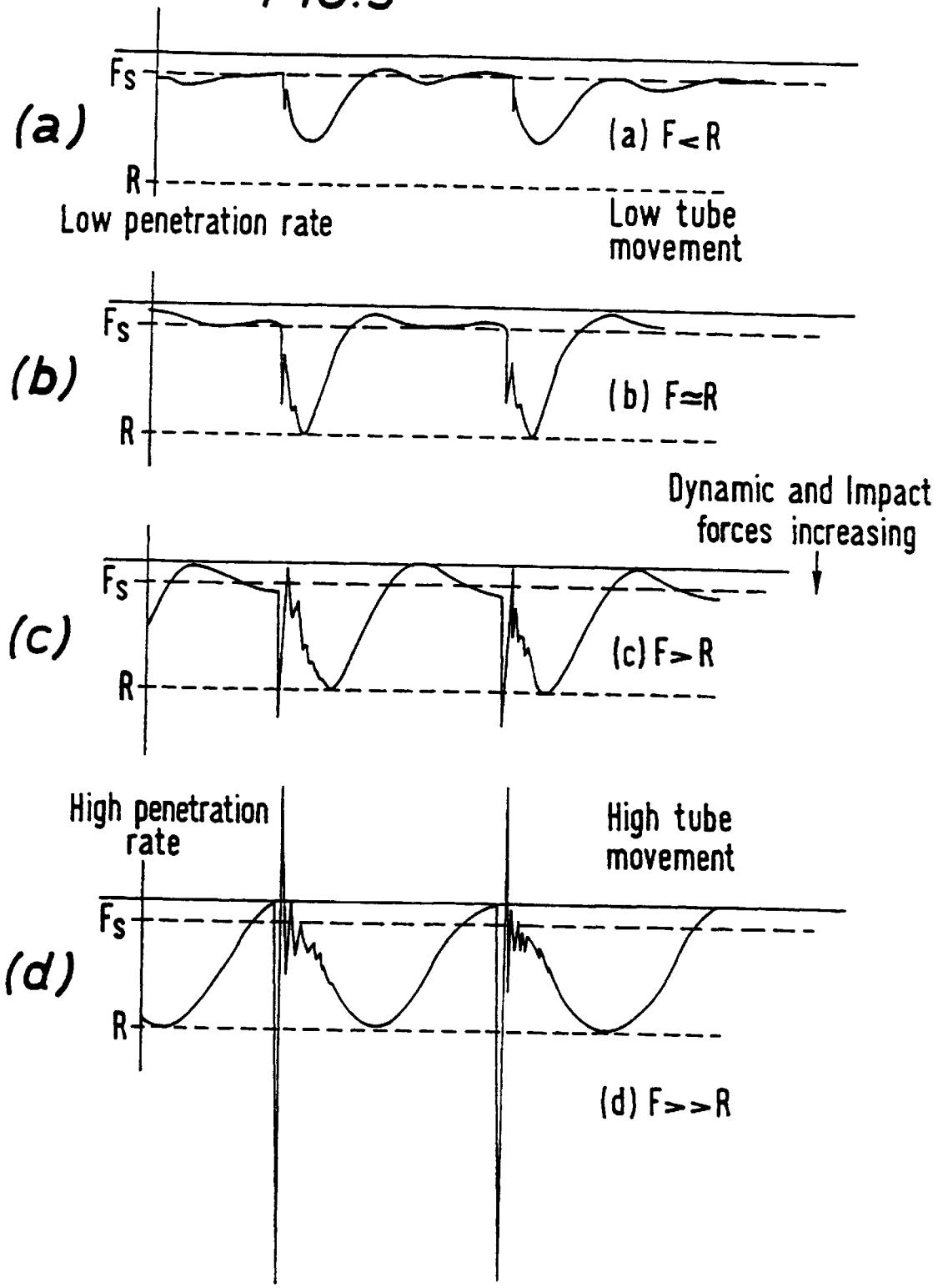
Figure 6:
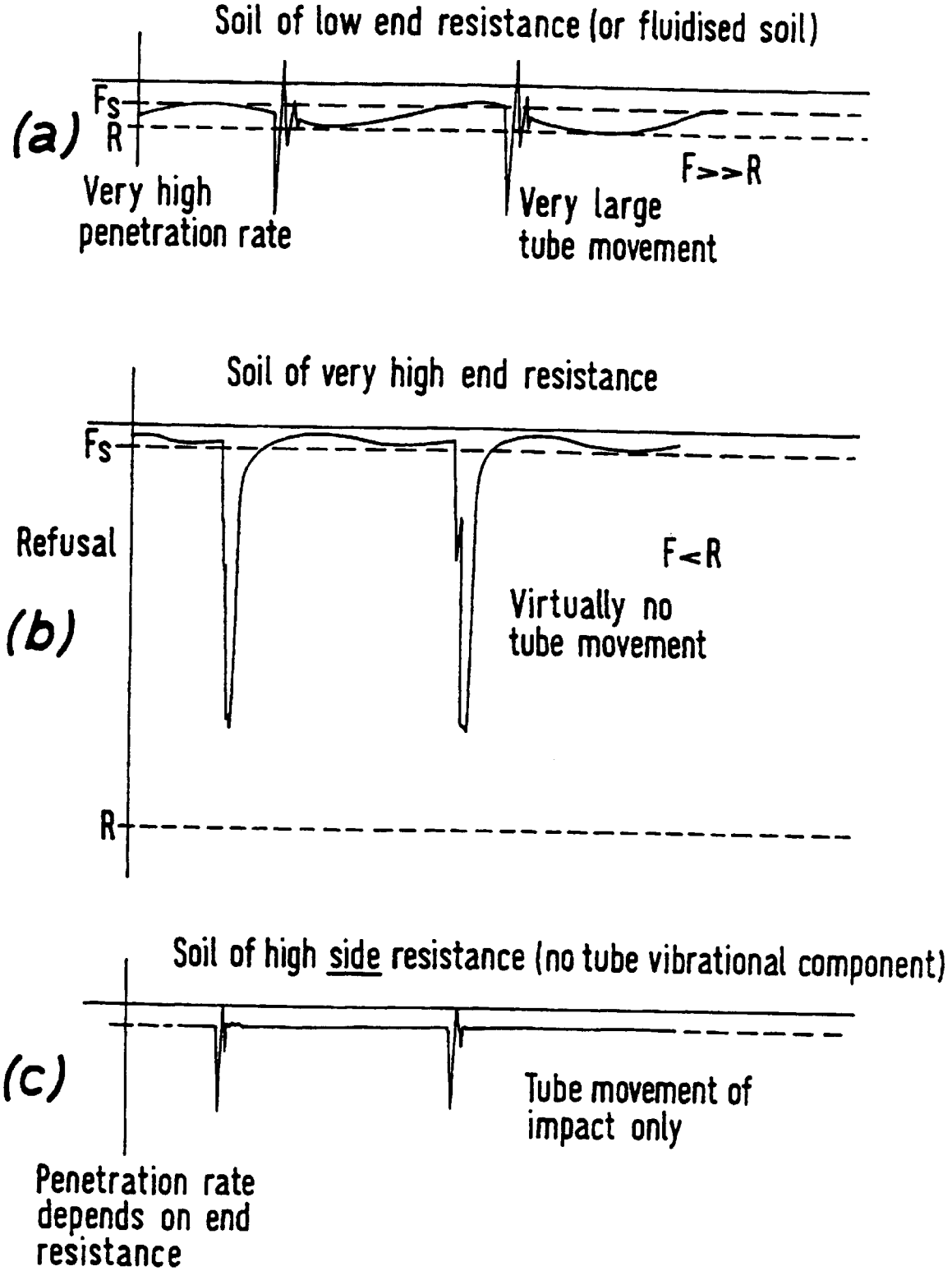
Figure 7:
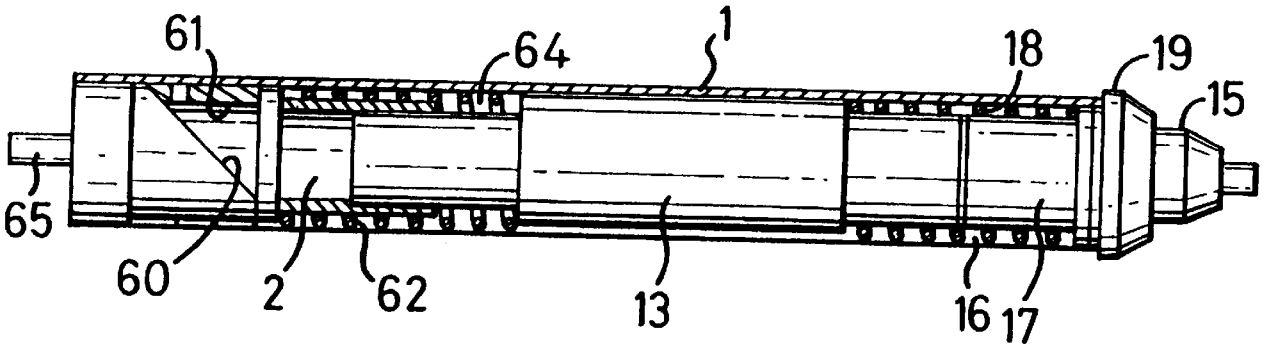
Figure 8:
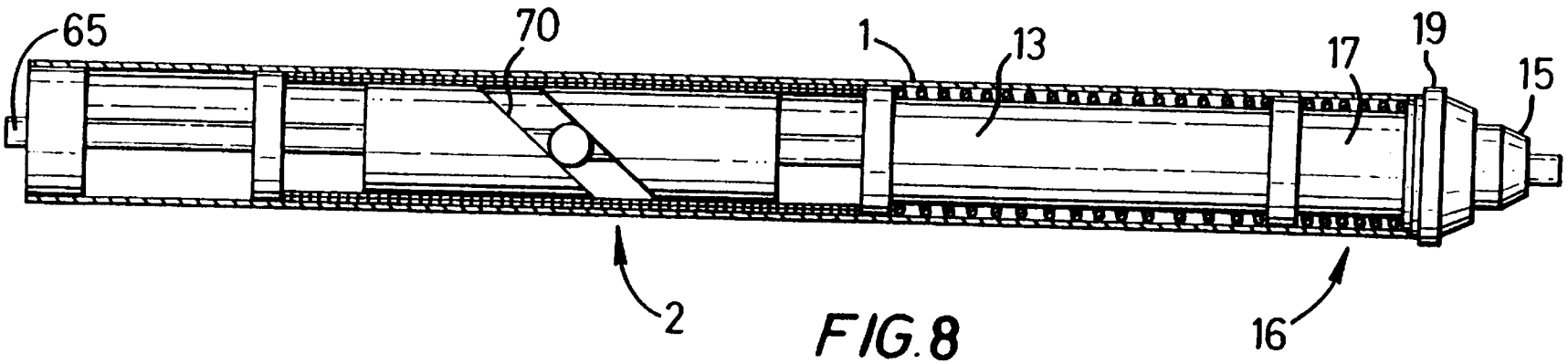

FIG. 4 schematically represents a zone of interaction between soil material ahead of and adjacent the head of a moling apparatus embodying the present invention during its progress through the ground;

FIG. 5 illustrates examples of the dynamic soil responses for the end resistance to penetration for a soil of high end resistance with a selected gap of zero;

FIG. 6 illustrates examples of dynamic soil responses for a variety of soils encountered;

FIG. 7 illustrates a partially cutaway longitudinal view through a moling apparatus of a third embodiment of the present invention; and FIG. 8 illustrates a partially cutaway longitudinal view through a moling apparatus of a fourth embodiment of the present invention.

In the various embodiments, common components bear common reference numerals.

Figure 1:
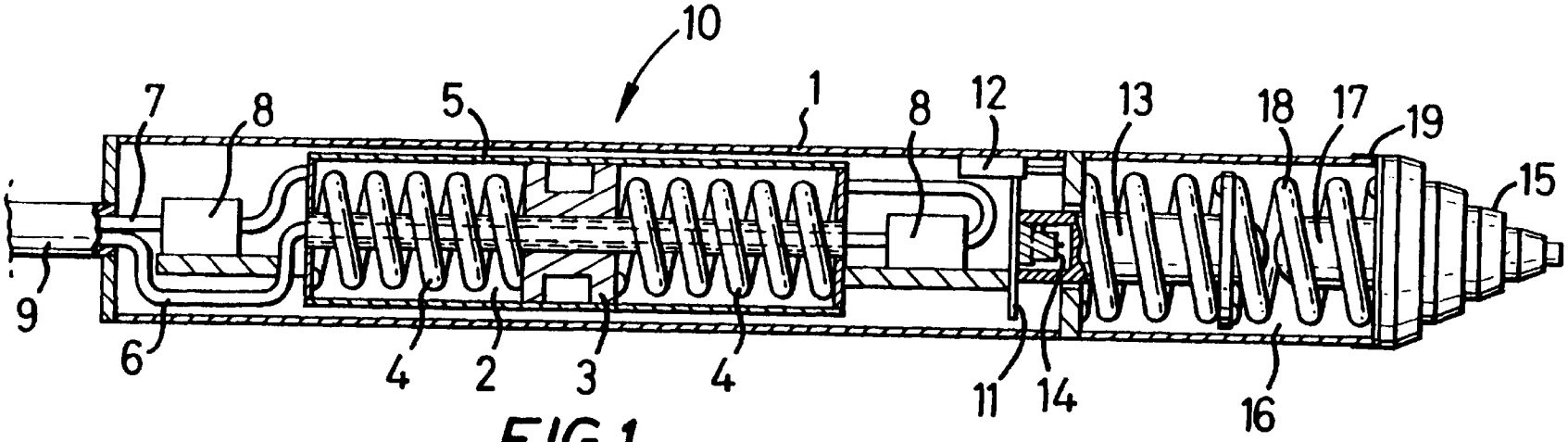
FIG. 1 illustrates a partially cutaway longitudinal view through a moling apparatus of a first embodiment of the present invention.

Referring to FIG. 1, a moling apparatus 10 of a first embodiment of the present invention comprises a cylindrical shell 1 having, in this case, an annular cross section of 100 mm in diameter and a length of 3.1 m, and a head 15. An annular load cell 19 is provided immediately behind the head 15 for sensing the ground resistance as the head passes through the ground.

Within the rear end of the shell 1 there is provided a vibrator unit 2. The vibrator unit 2 comprises a mass 3, which is rotationally symmetrical and H shaped in cross section, and two opposing coil springs 4, all located within a closed housing 5. The mass 3 is centrally located between the opposing coil springs 4 and is sealed against an inner surface of the housing 5 by means of labyrinth seals (not shown).

The respective spaces in the housing 5 either side of the mass 3 can be fed with compressed air by means of respective feed pipes 6 and 7, each feed pipe incorporating a switchable pneumatic valve 8. The pipes 6 and 7 lead to a supply of compressed air at the surface of the ground through a control conduit 9. By operating the valves 8 to alternate the air supply to either end of the closed housing 5, the driving energy of the compressed air oscillates the mass 3 at an operation frequency.

A plate 11 is connected to the housing 5 and a hammer 13 is connected to the plate 11. Thus, vibrations from the vibrator unit 2 are transmitted to the shell 1. A linear variable differential transformer (LVDT) 12 is mounted to an edge of the plate 11 for the purpose of measuring the relative displacement of the vibrator unit 2 and the hammer 13, and an accelerometer 14 is mounted in a space within the hammer 13 for the purpose of measuring the acceleration of the hammer 13.

Within the forward end of the shell 1 there is provided a vibro-impact unit 16 into which the hammer 13 extends. The vibro-impact unit comprises an anvil 17, mounted opposite the hammer 13, and a compression spring 18 for maintaining a selected gap between the hammer 13 and anvil 17. The anvil 17 is connected to the head 15. Thus, the hammer 13 and anvil 17 are spaced from each other by means of a resilient restraint means in the form of compression spring 18.

In use, the moling apparatus has two modes of operation. In a first vibration mode, the shell and head experience vibrations alone. This occurs if the displacement amplitude of the vibrator unit 2, which vibration is transmitted to the hammer 13, does not result in the hammer 13 vibrating at a magnitude which is greater than the above mentioned selected gap. This is the pure vibration mode of operation in which the head penetrates the ground by means of vibration only.

The vibration mode occurs if the resistance of the ground to the moling apparatus is relatively small. For example, ground made up of so-called cohesionless soils experience a significant shear strength reduction due to the vibrations and this results in a fluidization of the ground surrounding the apparatus.

If the resistance of the ground to the moling apparatus becomes relatively larger, for example in so-called cohesive soils, a greater proportion of the compressed air driving energy is expended on producing vibrational displacements of the vibrator unit 2 itself. Consequently the displacement amplitude of the vibrator unit increases relative to movement of the shell. Eventually, the displacement amplitude of the vibrator unit 2 , which vibration is transmitted to the hammer 13, does result in the hammer vibrating at a magnitude which is greater than the above mentioned selected gap so that the hammer 13 impacts on the anvil 17. This impact is communicated to the head 15. That is to say, the amplitude of the variation of the gap dimension is small for the vibration mode and as it increases there is a transition to the impact mode. The frequency of the impacts can also be an integer multiple of the frequency of the vibrator unit. This is the vibro-impact mode of operation in which the head penetrates the ground by means of impact and vibration.

In this second vibro-impact mode of operation the head penetrates the ground with a combination of vibration and impact with the magnitude of the impact varying according to the resistance of the ground. This mode occurs if the resistance of the soil to the moling apparatus is relatively large.

It will be apparent that the resistance of the ground to the moling apparatus depends on the type and condition of the soil making up the ground, for example whether the soil is clay, sand, wet, dry etc. Moreover, it will be apparent that the moling apparatus self adjusts to the soil type being encountered. That is to say, within the first mode, the apparatus self adjusts the vibrational energy to be imparted to the surrounding soil, self adjusts to the second mode, and within the second mode self adjusts the impact energy to be imparted to the surrounding soil. The apparatus is therefore able to relate its output in accordance with the type of soil material being encountered. In soils amenable to penetration by vibration alone the apparatus acts as vibro-driver. With more resistant soil material, the apparatus provides a combination of vibration and impact, with the level of impact varying according to the soil type. This self adjusting aspect of the apparatus assists penetration through a wide range of soil types whilst minimising disturbance to the surrounding soil.

It will be apparent that the compression spring 18 and the gap between the hammer 13 and anvil 17 can be made to be variable thereby altering the self adjusting performance of the moling apparatus. Furthermore, the frequency of the vibrator unit 2 can have an effect on penetration rates with a correlation between frequency and penetration having been found up to 26 Hz.

Figure 2:
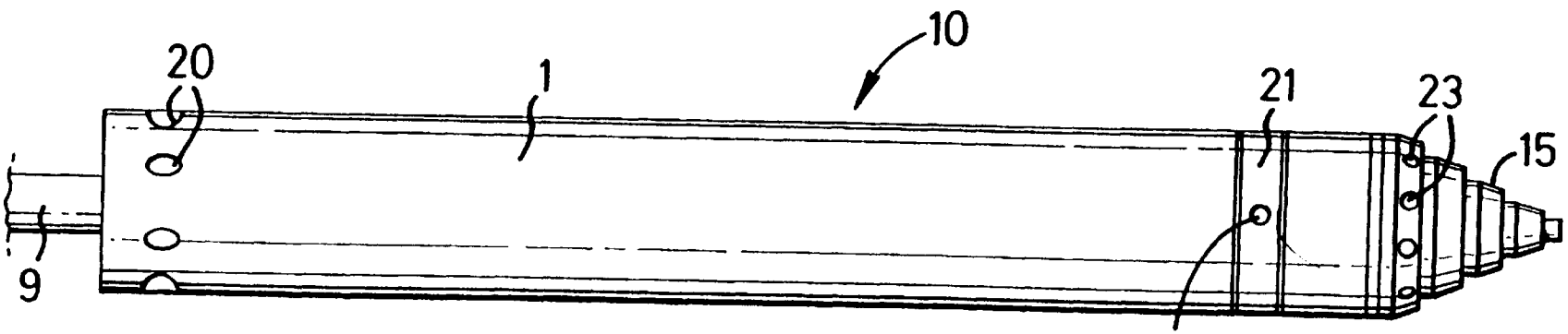
FIG. 2 illustrates an external view of a moling apparatus of a second embodiment of the present invention.

Referring to FIG. 2, a moling apparatus 10 has a series of rear apertures 20 provided circumferentially around the rear end of the shell 1. In addition, the shell 1 includes a rotatable collar 21 having an aperture 22 provided therein which is hence rotatable about the axis of the shell 1 by means of rotation of the collar 21. Moreover, a series of head apertures 23 are provided along a surface of the stepped head 15.

By arranging apertures in this way, a fluid jet arrangement is provided whereby fluid can be projected at an area of ground adjacent the moling apparatus. Any suitable fluid may be employed, for example water, air or the like. The fluid jet arrangement can be used to weaken the ground adjacent the apparatus so as to assist penetration therethrough or can be used to steer the moling apparatus through the ground. The detailed construction of the supply of fluid to the apertures is not shown for the purpose of clarity and because the detailed mechanism for such supply will be readily apparent to a person skilled in the art. The fluid to the apertures can be provided through control conduit 9 from an externally pumped supply. Alternatively, an internally pumped supply of fluid can be used.

The head apertures 23 function in a different manner from the rear apertures 20. In particular, in order to direct the moling apparatus in a desired direction, selected rear apertures 20 expel fluid so as to fluidize the area of ground that lies adjacent the shell in the desired direction of movement. In this regard, the ground has already been weakened to a degree by the passage of the apparatus. The ground in that area forms a weakened fluidized annulus section into which the shell can move. In so doing, the head becomes directed into the desired direction of movement.

The head apertures expel fluid to create reactive forces with the still relatively hard ground they are about to penetrate. Therefore, in contrast with the rear apertures, the head apertures expel fluid in an opposing direction to the desired direction of movement. The pressure and volume of fluid passed through the apertures is regulated since too much fluidization of the adjacent ground can cause sinking of the apparatus because there is nothing solid to react against. The rotatable aperture 22 provides a single jet which may be rotated to direct a stream of fluid at any point from the circumference of the shell.

The fluid jet arrangement may comprise the single adjustable aperture, and/or apertures provided at the front and/or the rear of the shell 1. They may for example be pneumatically operated, selectively operable and may be remotely controlled by way of a computer of directly by an operator.

Figure 3:
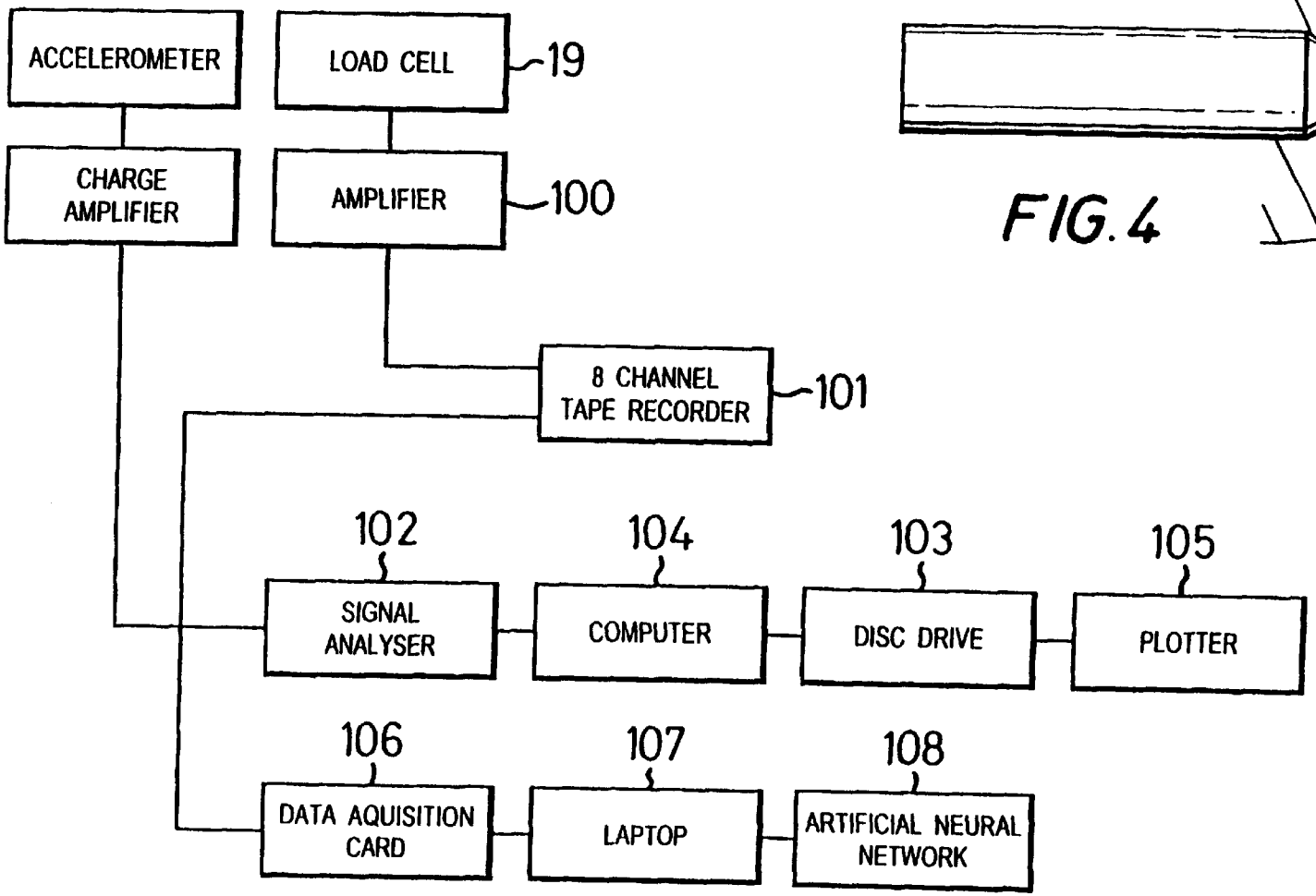
FIG. 3 illustrates a block diagram of a ground sensing system embodying the present invention.

FIG. 3 shows a circuit diagram for a ground sensing system for use with the moling apparatus of FIGS. 1 or 2. Various components of this ground sensing system can be mounted within the shell 1.

As noted above, known moling apparatus are blind to obstacles in the ground so that the obstacle either presents an insurmountable barrier or the obstacle, such as a pipe, can be damaged. The present inventors have noted that during penetration of ground, there is an area of soil material ahead of and adjacent the head of the moling apparatus that interacts with the apparatus during its progress through the ground. This is schematically represented in FIG. 4 which shows a moling apparatus and a shaded zone of influence in which there is soil participating in the overall soil collapse mechanism. In particular, there is a zone of soil failure extending forward of the apparatus up to at least twice the diameter thereof which is actively reacting with the vibration and/or impacts provided by the apparatus. Thus, the condition and type of soil ahead of the apparatus during use influences the moling apparatus.

Now because the moling apparatus self adjusts on the basis of the soil resistance encountered, which, as shown in FIG. 4, depends on the soil condition and type of the zone of soil collapse which includes that ahead of the front end of the apparatus, it can be seen that the dynamic soil response will provide an indicator of the soil condition and type ahead of the apparatus. Accordingly, by monitoring the dynamic soil response and by matching or approximately matching the dynamic soil response with stored or learnt data for known soil conditions, types, and the influence of obstacles, it is possible to ascertain the soil condition, type and obstacle ahead of the moling apparatus and thereby obtain forewarning of the presence of obstacles. It is then possible to steer around such obstacles as they are encountered.

FIG. 5 illustrates the dynamic soil responses for the end resistance to penetration for a soil of high end resistance with a selected gap of zero. FIG. 5(*a*) shows the initial position where the force F generated by the apparatus relative to the soil plastic resistance is low. As the force increases, the penetration increases and it can be seen that by the time F>>R FIG. 5(*d*), the penetration rate is high and the signature has changed.

FIG. 6 illustrates a variety of dynamic soil responses. It should be noted that the waveforms are influenced by soil conditions, apparatus parameters and the depth at which the measurements are taken. FIG. 6(*a*) illustrates the waveform or signature for a soil of low end resistance, that is to say, a cohesionless soil where fluidisation is induced. FIG. 6(*b*) illustrates the waveform or signature for a soil of very high end resistance, that is to say, a soil inducing high end resistance or a rock. FIG. 6(*c*) illustrates the waveform or signature for a soil of high side resistance where the vibrational component is small, that is to say, a soil which generates a very high side resistance such as stiff clay.

Referring to FIG. 3, the load cell 19 supplies an output via an amplifier 100 to an 8 channel tape recorder 101. A signal analyser 102 analyses the waveform from the load cell which can be stored on a disk drive 103 by a computer 104 and plotted on a plotter 105. The waveform from the load cell is also relayed via a data acquisition card 106 to a laptop computer 107 connected to an artificial neural network 108. In this way, the network 108 can scan a stored database or library of waveforms (not shown) so as to recognise the type of soil condition that is currently within the zone of influence of the moling apparatus. The signal analyser 102 can additionally provide outputs representative of penetration against time, vibrator unit acceleration, vibrator unit velocity, anvil force, hammer velocity, hammer/anvil gap. It will be apparent that the waveform characteristic can be a raw waveform or can be a normalised waveform characteristic.

The neural network is initially set up to decide on the soil condition and type of the ground through which the moling apparatus is passing on the basis of waveforms stored in the library. These initial waveforms can be pre-loaded or learnt. It should be noted that the behaviour characteristic of the moling apparatus is dependent on the precise construction and assembly of the individual apparatus. Thus, a learning or calibration routine is incorporated into the neural network. During this routine, the neural network learns waveforms for different soil conditions, types and the influence of obstacles. Thereafter, the neural network system can recognise or provide an educated guess regarding soil conditions, types and obstacles ahead of the apparatus on the basis of this learned data. The actual soil condition, type or risk of an obstacle can be displayed to a user on the surface by means of a display (not shown).

As an alternative or in addition to a neural network system, other forms of waveform recognition software can be employed, for example fuzzy logic, or other algorithms.

Referring to FIG. 7, a moling apparatus of a third embodiment of the present invention is illustrated. In this case, the vibrator unit 2 takes the form of a rotatable face cam 60 which contacts a follower 61 which in turn compresses a spring 62. The spring 62 acts on the hammer 5 to produce an oscillating force. The cam follower 61 is held against the cam 60 by pre-load in the spring 62. A keyway 64 ensures correct orientation between the cam and the follower at all times. A rotatable drive shaft 65 is connected to the cam 60.

In use, the drive shaft 65 is rotated at the surface thereby causing the cam 60 to rotate against the cam follower 61 which is spring biased and in interconnection therewith. This provides a vibration which causes the hammer 13 to vibrate against the spring 18. As with the first embodiment, the vibration of the hammer causes the shell 1 and head 15 to experience vibrations alone. This occurs if the displacement amplitude of the vibrator unit 2, which vibration is transmitted to the hammer 13, does not result in the hammer 13 vibrating at a magnitude which is greater than the gap between the hammer and anvil. This is the vibration mode of operation.

If the resistance of the ground to the moling apparatus becomes relatively larger, the displacement amplitude of the vibrator unit 2 eventually reaches a point where it overcomes the separating force between the hammer and anvil by an amount resulting in the hammer striking the anvil. This is the vibro-impact mode of operation. The apparatus of this embodiment self adjusts between and within each mode a with the first embodiment.

Referring to FIG. 8, a moling apparatus of a fourth embodiment of the present invention is illustrated which is more elongate than the third embodiment. In this case, a double faced cam 70 is driven by the rotatable drive shaft 65 and the oscillating force thereof vibrates the hammer 16. Thus, as with the third embodiment, a moling apparatus is provided which has a vibration mode and a vibro-impact mode and which apparatus self adjusts between and within each mode.

It will be apparent that the moling apparatus and ground sensing system of the present invention can be employed for tunnelling, piling or coring and is not limited to tunnelling. Moreover the drive force for the vibrator unit 2 can be provided by a rotary drive, pneumatic drive, electric drive or the like. Whilst a positive gap between the hammer and anvil has been illustrated, it will be appreciated that a zero or negative gap can be employed.

It will also be understood that the embodiments illustrated show particular applications of the invention for the purposes of illustration only. In practice, the invention may be applied to many different configurations, the detailed embodiments being straightforward for those skilled in the art to implement.

What is claimed is:

1. A ground sensing system comprising:

a projectile;

driving apparatus that drives the projectile through ground having resistance to movement therethrough, said driving apparatus including means for self adjustment, according to the resistance of the ground encountered, between a vibration mode providing vibration driven penetration of ground and a vibro-impact mode providing vibration and impact driven penetration of ground;

sensing means located on the projectile;

signal processing means for processing the output of said sensing means to provide a dynamic resistance waveform representative of the dynamic resistance of the ground that the projectile is passing through; and waveform recognition means for correlating said dynamic resistance waveform with stored dynamic waveforms for identifying a ground characteristic.

2. A ground sensing system according to claim 1 wherein the projectile forms a part of said driving apparatus.

3. A ground sensing system according to claim 1 wherein said waveform recognition means comprises a neural network system.

4. A ground sensing system according to claim 1 wherein said waveform recognition means comprises a fuzzy logic system.

5. A ground sensing system according to claim 1 further comprising display means for providing an output signal indicative of the identified ground characteristic.

6. A ground sensing system according to claim 5 wherein said display means displays the identified ground characteristic to an operator.

7. A ground sensing system according to claim 1 further comprising a store means for containing a library of dynamic waveforms.

8. A ground sensing system according to claim 1 further comprising a store means for storing a library of dynamic waveforms in accordance with operator information and dynamic waveforms provided by said signal processing means.

9. A ground sensing system according to claim 1 wherein said driving apparatus comprises:

a head;

a vibrator unit connected to apply vibrations to the driving apparatus for providing said vibration mode of vibration driven penetration of ground;

a hammer vibrated by the vibrator unit;

an anvil;

resilient means provided for applying a separating force to keep the anvil and hammer a selected distance apart;

wherein the vibrator unit self adjusts to increase the amplitude displacement of the vibrated hammer according to increased penetration resistance from said ground until a point where said amplitude displacement overcomes said separating force by an amount resulting in the hammer striking the anvil for said vibro-impact mode of vibration and impact driven penetration of ground.

* * * * *